United States Patent [19]

Hockman

[11] 4,383,562

[45] May 17, 1983

[54] SPLITTING DEVICE

[76] Inventor: Mark E. Hockman, 672 Mount Rd., Aston, Pa. 19014

[21] Appl. No.: 182,149

[22] Filed: Aug. 28, 1980

[51] Int. Cl.[3] ..... B26B 23/00

[52] U.S. Cl. ..... 145/2 R; 144/193 C; 144/193 D

[58] Field of Search ..... 145/2 R; 144/193 C, 144/193 D, 193 E, 193 F

[56] References Cited

U.S. PATENT DOCUMENTS 3,865,163 2/1975 Root ..... 145/2 R 4,044,808 8/1977 Kolonia ..... 144/193 D

FOREIGN PATENT DOCUMENTS 443758 3/1975 U.S.S.R. ..... 144/193 C

*Primary Examiner*—James G. Smith

*Assistant Examiner*—J. T. Zatarga

*Attorney, Agent, or Firm*—Ratner & Prestia

[57] ABSTRACT

A log splitter comprising a head portion having a cutting edge with two pivoting members each pivoting member contains cutting and thrust levers located on a single pivot point. The cutting levers are located along the head portion cutting edge. The thrust levers are displaced from the head portion cutting edge on opposite sides. When thrust against a log, the cutting levers and the head portion cutting edge simultaneously penetrate the log, followed by contact of the thrust levers causing the cutting levers to rotate outwardly in opposite directions thereby enhancing splitting of the log.

6 Claims, 6 Drawing Figures

SPLITTING DEVICE

BACKGROUND OF THE INVENTION

A. Field of the Invention

This invention relates to a device useful for splitting objects, in particular wood. The device is hand-operated in a manner similar to the operation of a conventional axe.

B. Background Art

Wood splitting is old and many devices have been developed throughout the years. Prior art hand-operated wood splitters have been limited to maul-type axes or wedge and sledge hammer devices. Such devices were not efficient and usually required successive operations with the striking of one implement by another.

One such prior art device is disclosed in U.S. Pat. No. 3,865,163. This device is a splitting wedge and has spreader arms pivotally disposed on the centerline of the wedge. The free ends of the spreader arms engage and further split the wood after the wedge has started the split. The spreader arms are not mounted on the head portion of the wood splitter. Moreover, this device is used in conjunction with a hydraulic cylinder having its piston rod directly attached to the wedge being forced into the wood and is not a manually operated device. Thus, this device is cumbersome and not suited for manual operation.

A recent prior art is disclosed in U.S. Pat. No. 4,044,808. This hand-operated device contains two movable levers pivotally mounted at two respective points off the centerline and on opposing sides of the head portion. These levers criss-cross each other through an opening in the head portion and swing outward to opposing sides from their resting position. These levers contact the object to be split after the cutting edge splits the wood, thus causing the levers to swing outward in opposite directions and further split the object. This device is an improvement over prior hand-operated devices since the lateral splitting force is generated from direct contact with the lever ends. This device, however, still has the same deficiencies as the device previously described. Since the levers are not part of the cutting edge, the levers engage the object to be split only after the cutting edge enters the object. Thus, if the cut made by the cutting edge is wider than the width of the two levers, the device becomes ineffective, since the levers cannot properly engage the object.

Also relevant are U.S. Pat. Nos. 3,749,365 and 3,982,572.

It is, therefore, an object of this invention to provide a device useful for splitting objects such as wood and logs which is well suited for manual operation.

A further object of this invention is to provide a device which can efficiently split an object by ensuring that the thrust mechanism is always effective in engaging and splitting the object.

Yet another object of this invention is to provide a device which has not only a rotating thrust mechanism but also a rotating cutting mechanism, the latter being located along the cutting edge of the head portion, thereby ensuring proper engagement with the object to be split.

SUMMARY OF THE INVENTION

A device for splitting objects comprising a head portion having a cutting edge with two pivoting means mounted on the head portion, each pivoting means having cutting lever means and thrust lever means, said cutting lever means having an edge along the head portion cutting edge and said thrust lever means displaced from the head portion cutting edge. When thrust against an object, the cutting lever means enter the object simultaneously with the head portion cutting edge followed by the thrust lever means contacting the object displaced from the area the cutting lever means entered the object, thereby causing the cutting lever means to rotate outwardly enhancing splitting of the object.

DESCRIPTION OF SPECIFIC EMBODIMENTS

Figure 1:
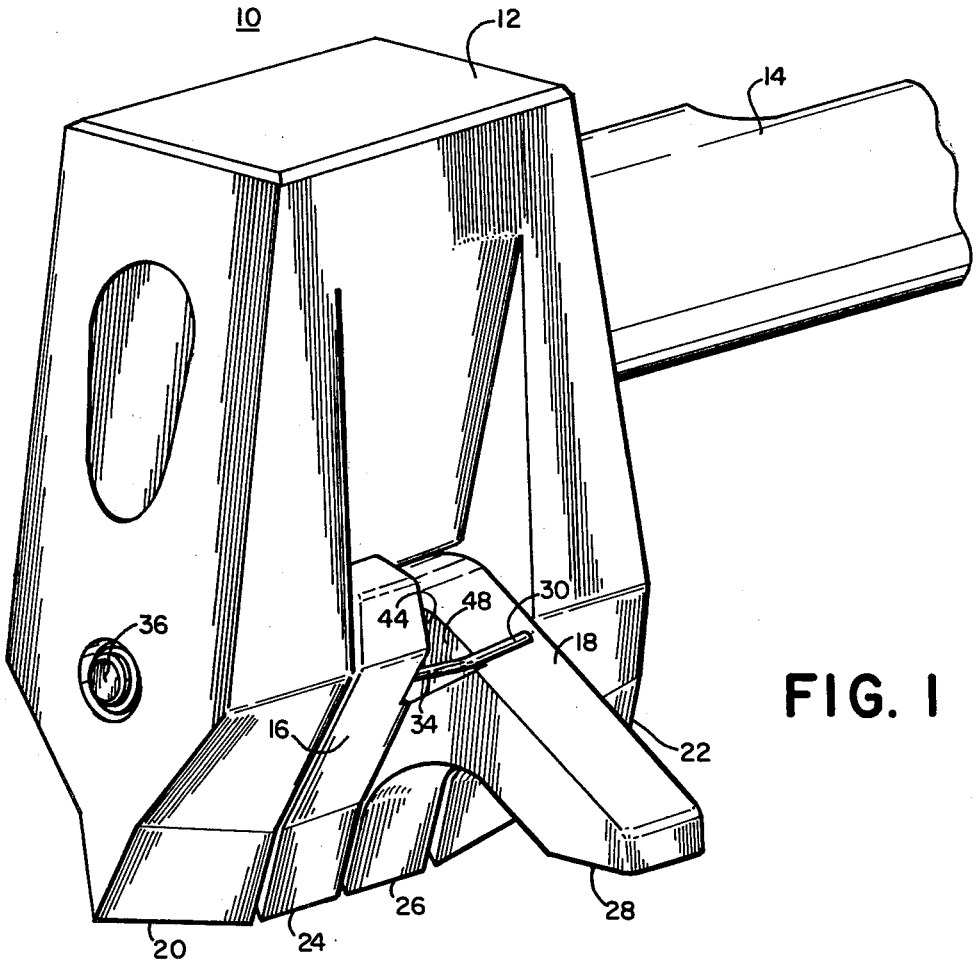
FIG. 1 is a perspective view of a device made in accordance with this invention.
Figure 6:
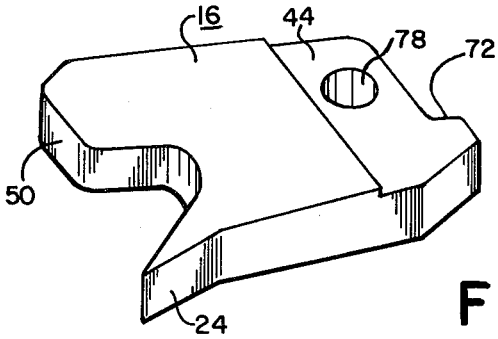
FIG. 6 is a perspective view of one pivot member used with the device of FIG. 1.
Figure 2:
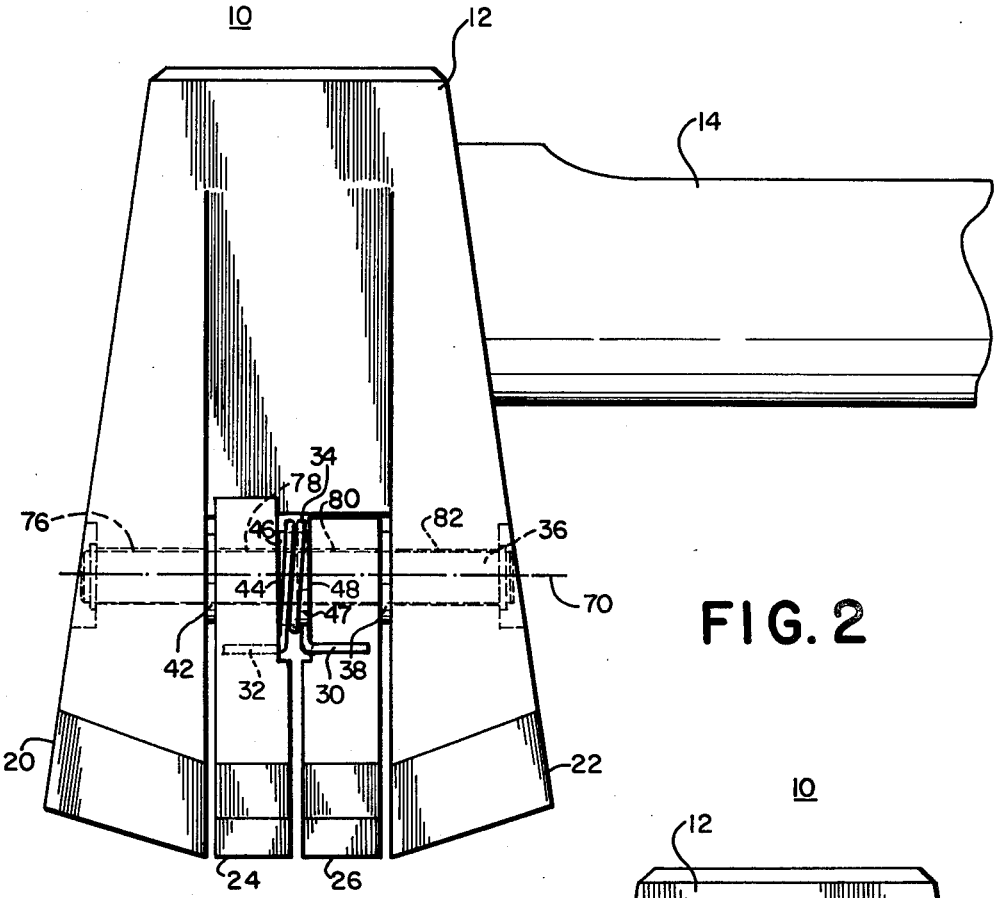
FIG. 2 is a side-elevational view of the device of FIG. 1 as viewed from the right.
Figure 3:
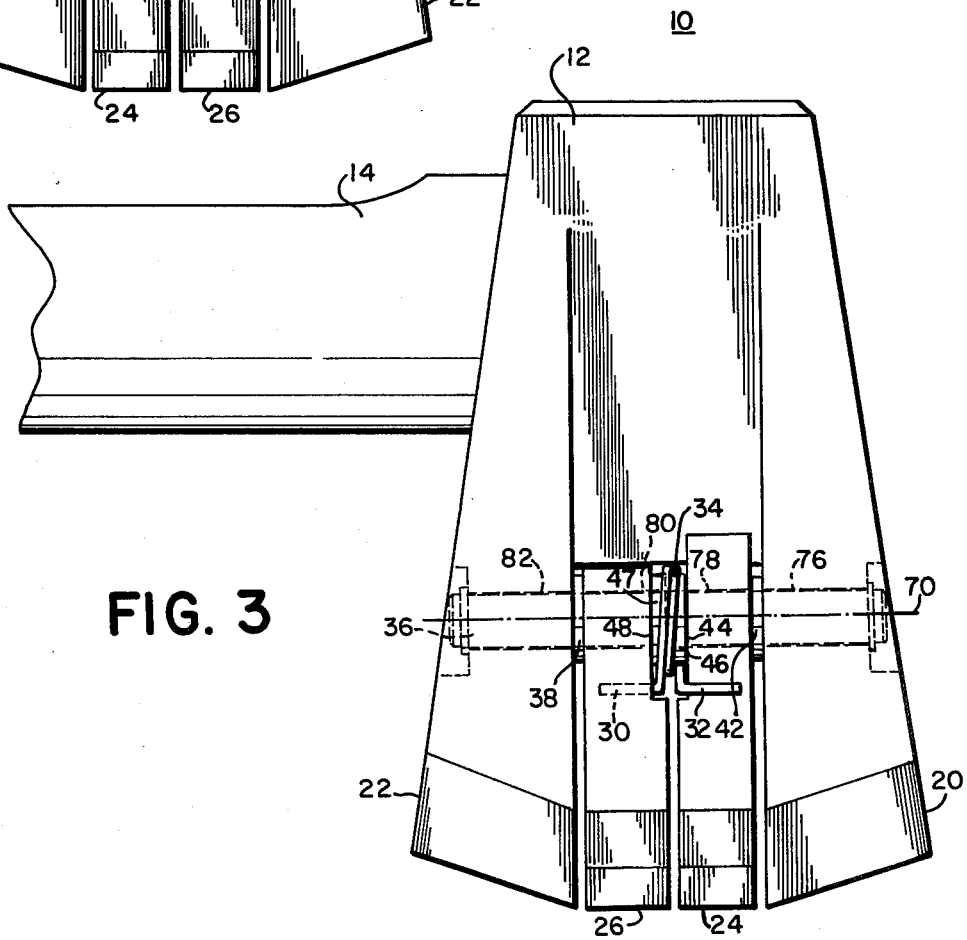
FIG. 3 is a side-elevational view of the device of FIG. 1 as viewed from the left.

Referring to FIGS. 1–4, the splitting device, generally designated 10, includes head portion 12 mounted on handle 14. Pivot members 16 and 18 are pivotally mounted on pivot pin 36 located centrally on pivot centerline 70, which is perpendicular to head portion centerline 60. Head portion centerline 60 extends in the longitudinal dimension substantially through head portion cutting edges 20 and 22. It is important to note that in the embodiment of this invention pivot members 16 and 18 have a single pivoting axis located on the longitudinal dimension of head portion or plane 12 passing through cutting edges 20 and 22. The first pivot member 16 contains cutting lever 24 and thrust lever 50, whereas second pivot member 18 contains cutting lever 26 and thrust lever 28. Shown more clearly in FIG. 6 is first pivot member 16; it will be understood that second pivot member 18 is identical to pivot member 16. Members 16 and 18 are mounted on pivot pin 36 by way of pivot points 78 and 80, respectively. Members 16 and 18 are separated from each other and from head portion pivot holes 76 and 82 by way of washers 38, 42, 46 and 47, as shown in FIGS. 2 and 3. Washers 46, 47 rest between undercut surfaces 44 and 48 of pivot members 16 and 18, respectively. It will be understood that washers 46, 47 are needed to give spring 34 sufficient clearance and prevent pivot members 16 and 18 from compressing spring 34 during pivoting.

Figure 4:
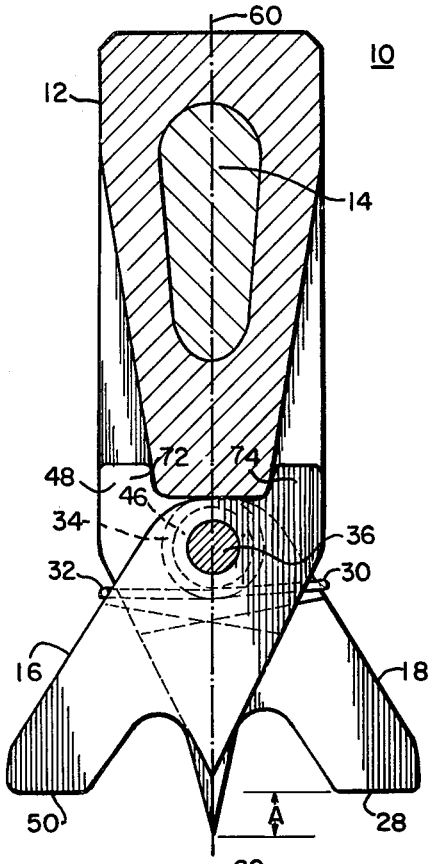
FIG. 4 is a top-plan view of the device of FIG. 1 with pivoting members in the rest position.

Mounted on pivot pin 36, pivot members 16 and 18 are held in their resting position by abutment faces 72, 74 and spring 34. Abutment faces 72 and 74 are located at the pivot ends of pivot members 16 and 18, respectively, as shown in FIG. 4, and are contiguous to the surface of head portion 12 when the pivot members are in their resting position. A biasing means is required to keep pivot member 16 and 18 in their resting position when device 10 is being thrust against an object to be split. Spring 34, a single torsion spring, provides such biasing means and is spirally mounted around washers 46,47. Arms 30 and 32 of spring 34 provide positive forces for holding abutment faces 72 and 74 against the outside surfaces of head portion 12.

When pivot member 16 and 18 are in their rest position, cutting levers 24 and 26 are in vertical alignment with head portion cutting edges 20 and 22, and extend through head portion centerline 60. Furthermore, cutting levers 24 and 26 extend radially to be in horizontal alignment with head portion cutting edges 20 and 22, so that the cutting levers and cutting edges will enter the object to be split simultaneously, as shown in FIG. 4.

Thrust levers 28 and 50 are displaced laterally from and on opposite sides of head portion centerline 60, as shown in FIG. 4. It will be understood that the displacement of thrust levers 28 and 50 is important due to the importance of assuring that the thrust levers will engage the object although the splitting of the object has already been started by the cutting levers and cutting edges. The outer end surfaces of thrust levers 28 and 50, in their rest position, are substantially perpendicular to head portion centerline 60. Such construction allows the entire outer end surface of each thrust lever to engage the object to be split, thus increasing the efficiency of the thrust. Moreover, the thrust levers are constructed so that their outer end surfaces impact the object only after the cutting levers have had opportunity to enter the object. This is accomplished by making the ends of the cutting levers extend perpendicularly by the distance "A", shown in FIG. 4, from the horizontal plane formed by the outer end surfaces of the thrust levers. It will be understood that the distance "A" must be large enough to permit the cutting levers to sufficiently enter the object to be split and engage a sufficiently large wall area of the object before forcing the walls apart. For example, if the distance "A" is greater than ½ inch, a sufficiently large crack can be made before the cutting levers first begin to force the walls apart.

Figure 5:
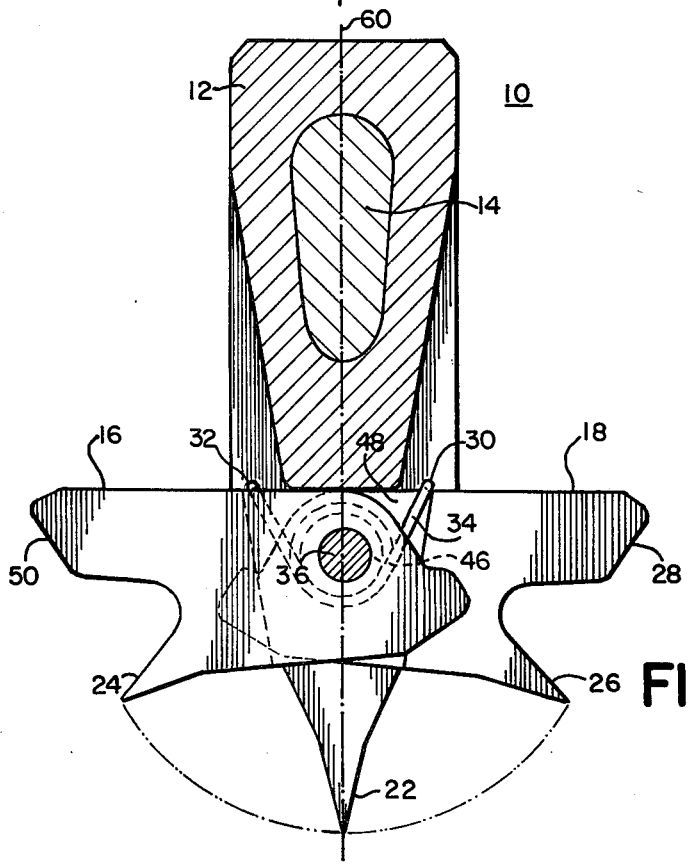
FIG. 5 is a top-plan view of the device of FIG. 1 with pivoting members in the work position.

In operation, device 10 is manually thrust against an object, such as a log, through the use of handle 14 in a manner substantially similar to using a conventional axe. During the downward thrusting of device 10, pivot members 16 and 18 are held in their resting position by spring 34. On impact with the object, cutting levers 24 and 26, simultaneously with head portion cutting edges 20 and 22, form a crack in the object. It will be understood that the cutting edges and cutting levers are sufficiently wide to begin splitting the object and displace the cut walls of the object to form an opening or crack equal to the cross-sectional area of the cutting edges and levers. Therefore, the thrust levers contact the object displaced from the area the cutting edges and levers entered the object. As the cutting levers continue penetrating the object, thrust levers 28 and 50 then contact the surface of the object and begin rotating outwardly in opposite directions. The contact of the thrust levers causes the force of the spring to be overcome and cutting levers 24 and 26 also begin rotating outwardly in opposite directions to their working position shown in FIG. 5. It will also be understood that the downward force is transferred from the thrust levers to the cutting levers providing a horizontal force against opposing walls of the crack thereby enhancing the splitting of the object.

While there have been described above the principles of this invention in connection with a specific embodiment, it is to be clearly understood that this description is made only by way of example and not as a limitation to the scope of this invention.

What is claimed is:

1. A device for splitting logs comprising a head portion having two elongated converging sides forming a cutting edge at the intersection thereof, said cutting edge defining an edge plane in the direction of elongation and between the sides, said head portion having an opening therethrough from side to side, a single pivot member within and across said opening, the longitudinal axis of said pivot member being generally parallel to said cutting edge and disposed within said edge plane, a pair of splitting levers pivotally mounted on said pivot member, each having a splitting face section separated from a log-engaging end, in its rest position the long axis of said splitting face section lies substantially within the edge plane, each splitting lever being swingable in a direction transversely of a respective side of said head portion, each splitting lever having its log-engaging end engage an end of the log shortly after the head portion contacts the log end with force to cause said cutting edge to penetrate and to form a split therein, as the head portion enters the split the log-engaging ends are thrust against the log and each entirely displaced from corners of the split, and a lever plane defined between each log-engaging end and, perpendicular to, the long axis of the splitting face section, a void formed in each splitting lever on the side of said lever plane away from the cutting edge and between the log engaging end and the splitting face section such that as the head portion further enters the split, the splitting lever pivots and the corner of the split enters the void and moves therein without binding on the splitting lever.

2. The device of claim 1 in which said head portion comprises a single opening having said splitting levers pivotally mounted therein.

3. The device of claim 2 in which said single pivot member comprises a single pivot rod having its opposing ends held within holes in said head portion at opposite surfaces of said single opening, each of said holes extending through the head portion to respective end faces and means for securing said pivot rod within recesses in said end faces.

4. The device of claims 2 or 3 in which there is provided a single torsion spring for biasing said pair of splitting levers to their rest position.

5. The device of claim 4 in which said single torsion spring comprises a single wound torsion spring having a pair of ends embracing respective splitting levers on upper surfaces opposing a respective lever arch, said torsion spring being spirally wound around the pivot member and mounted between the splitting levers.

6. A device for splitting logs comprising a head portion having two elongated converging sides forming a cutting edge at the intersection thereof, said cutting edge defining an edge plane in the direction of elongation and between the sides, said head portion having a single opening therethrough from side to side, a single pivot member within and across said opening, the longitudinal axis of said pivot member being generally parallel to said cutting edge and disposed within said edge plane, a pair of splitting levers pivotally mounted on said pivot member within the single opening, each having a splitting face section separated from a log engaging end by a lever arch which is concave in a direction away from the cutting edge, in its rest position the long axis of said splitting face section lies substantially within the edge plane, each splitting lever being swingable in a direction transversely of a respective side of said head portion, a single wound torsion spring having a pair of ends embracing respective splitting levers on upper surfaces opposing a respective lever arch, said torsion spring being spirally wound around the pivot member and mounted between the splitting levers for biasing said pair of splitting levers to their rest position, each splitting lever having a recessed section adjacent the torsion spring and means for maintaining the spacing between the splitting levers thereby to provide clearance for said torsion spring and prevent compression thereof, and each splitting lever having its log-engaging end separated from its respective side by said lever arch and in position to engage an end of the log shortly after the head portion contacts the log end with force to cause said cutting edge to penetrate the log end and to form a split therein, as the head portion enters the split the log-engaging ends are thrust against the log and each entirely displaced from edges of the walls of the split to allow a wall edge to freely enter each lever arch whereby each log-engaging end rotates and imposes a transverse spreading force on the split as each wall edge continues to enter each lever arch.

* * * * *